US005662532A

United States Patent [19]

Mizumura

[11] Patent Number: 5,662,532

[45] Date of Patent: Sep. 2, 1997

[54] GOLF CLUB

[76] Inventor: Shoichi Mizumura, 7-40-13, Takashimadaira, Itabashi-ku, Tokyo, Japan

[21] Appl. No.: 568,588

[22] Filed: Dec. 7, 1995

[30] Foreign Application Priority Data

Dec. 9, 1994 [JP] Japan ..... 6-306427

[51] Int. Cl.[6] ..... A63B 53/00

[52] U.S. Cl. ..... 473/314

[58] Field of Search ..... 473/305, 312, 473/313, 314, 292, 293, 304, 334, 335

[56] References Cited

U.S. PATENT DOCUMENTS 1,703,199 2/1929 McClure ..... 473/413 X 2,820,638 1/1958 Morrison ..... 473/313 X 5,224,702 7/1993 Turner ..... 473/314

5,308,068 5/1994 Strand ..... 473/313 X

*Primary Examiner*—William H. Grieb

*Attorney, Agent, or Firm*—Wenderoth, Lind & Ponack

[57] ABSTRACT

A golf club in which a shaft attaching portion is located relative to a club head a predetermined distance behind the substantial center of a face of the head. A shaft is attached to the shaft attaching portion and is inclined toward the face side of the head. Also, the weight of the head is increased on the face side. The shaft may be attached to the shaft attaching portion in such a manner that the grip of the shaft crosses a plane which is orthogonal to a line which extends orthogonally from the lower portion of the face of the head.

8 Claims, 6 Drawing Sheets

GOLF CLUB

BACKGROUND OF THE INVENTION

1. Field of the Invention

The present invention relates to a golf club, and more particularly to a golf club suitable for swinging without twisting or turning a player's wrists.

2. Description of the Related Art

Of the golf clubs, a putter particularly requires a swing or stroke which is executed without twisting or turning a player's wrists. The putter is designed so as to putt a ball toward target with accuracy in order to roll the ball into a cup. For that reason, the path of movement of the club head should follow a straight line accurately and smoothly from a take-back to a follow-through without moving a face of the putter right and left i.e. opening or closing the face. To take such a swing, it is preferable to swing so that the player's target-side elbow moves in a direction toward the target without twisting or turning the player's wrists.

In a known putter, as shown in FIG. 6, a shaft 9 is attached to a head 10 in the vicinity of a putter face 11. The shaft 9 is attached so as to extend nearly parallel to a line L which is orthogonal to a sole 12 of the putter head drawn out from a lower end of the face 11 or the shaft may extend with a slight inclination in a direction departing from the line L.

Therefore, when a player grips a grip 13 and addresses a ball while keeping the putter in the center of his body so as to adjust the face 11 to the ball, since the shaft 9 of the club is nearly parallel to the line L which is orthogonal to a line extending orthogonally from the lower end of the face 11, the player's target-side wrist, which grips the grip 13, is bent toward the outside. In this state, a stroke is conducted without any change of form from the take-back to the follow-through.

As described above, with the conventional putter, when the player takes an address while keeping the putter centered with respect to his body so as to adjust the face 11 relative to the ball, the player's wrists are allowed to be twisted or turned during the stroke. Also, the player's target-side elbow is allowed to be drawn toward the body side. This leads to such a problem because it is very difficult to accurately and smoothly move the putter head along a straight line from a take-back to a follow-through while keeping the face square toward the target.

SUMMARY OF THE INVENTION

The present invention has been made in view of the above-noted problems, and an object of the invention is to provide a golf club that facilitates a swing in which a player's elbow can be moved toward a target without twisting or turning of the wrists.

In order to attain the above-mentioned object, the present invention provides a golf club or putter in which a shaft attaching portion is located relative to a putter head so as to be behind the substantial longitudinal center of a face of the putter head, and spaced by a predetermined distance from the face. A shaft is attached to the shaft attaching portion. The shaft is inclined with an inclination toward the face side of the putter head, and the weight of the head is increased on the face side.

The shaft may be preferably attached to the shaft attaching portion of the head in such a manner that the grip of the shaft crosses a line which is orthogonal to a line which is orthogonal to the lower edge of the face of the head.

According to the present invention, the shaft attaching portion is connected to the head and located a predetermined distance behind the substantial center of the face of the head relative to the longitudinal direction thereof at a predetermined interval. The shaft is attached to the shaft attaching portion so as to be inclined toward the face side. Thereby, when the player addresses a ball while keeping the club centered relative to the player's body, the player's target-side wrist, which grips the grip, is hardly bent outwardly, that is, the wrist is substantially straight. As a result, a stroke may be made without twisting or turning the wrist. Also, a stroke in which the elbow moves toward the target direction is facilitated. Also, the weight of the putter is increased at the face side, so that when the club is suspended by holding the grip, the face of the head is positioned substantially directly below the grip. As a result, a stroke can be conducted smoothly.

Furthermore, the shaft may be preferably attached to the shaft attaching portion of the head in such a manner that the grip of the shaft crosses a plane which is orthogonal to a line which extends orthogonally from a lower edge of the face of the putter head. Therefore, when the player holds the grip at the center of his body, the position of the face of the putter head is also positioned at the substantial center of his body. As a result, the player can hit the ball at the center of his body with a smooth swing.

The above and other objects and features of the present invention will be more apparent from the following description taken in conjunction with the accompanying drawings.

DETAILED DESCRIPTION OF THE PREFERRED EMBODIMENTS

Figure 1:
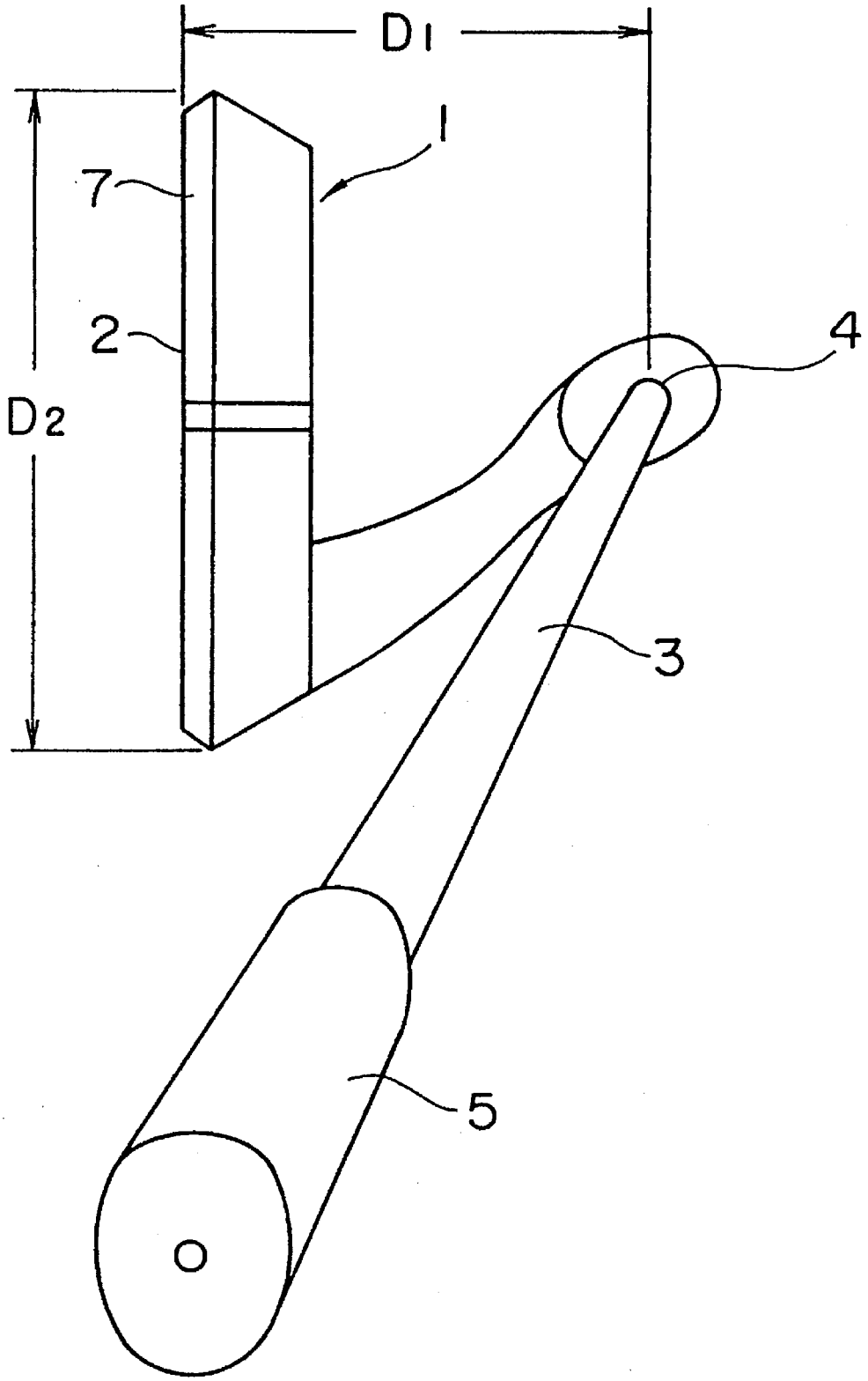
FIG. 1 is a plan view showing an embodiment of the present invention.

Hereinafter, a description will be given in more detail of embodiments of the present invention with reference to the attached figures.

The drawing figures show examples in which the present invention is embodied by a putting club, in which reference numeral 1 denotes a head; 2 denotes a face formed on the head 1; and 3 denotes a shaft attached to the head 1. A shaft attaching portion 4, to which the shaft 3 is attached, is located relative to the head 1 at a position which is directly behind the substantial center of the face 2 at a predetermined distance D1 from the face 2.

The distance D1 between the face 2 and the shaft attaching portion 4 is not particularly limited, but the distance D1 is preferably within a range of from not more than a length D2 of the face 2 to not less than ½ of the length D2.

Figure 2:
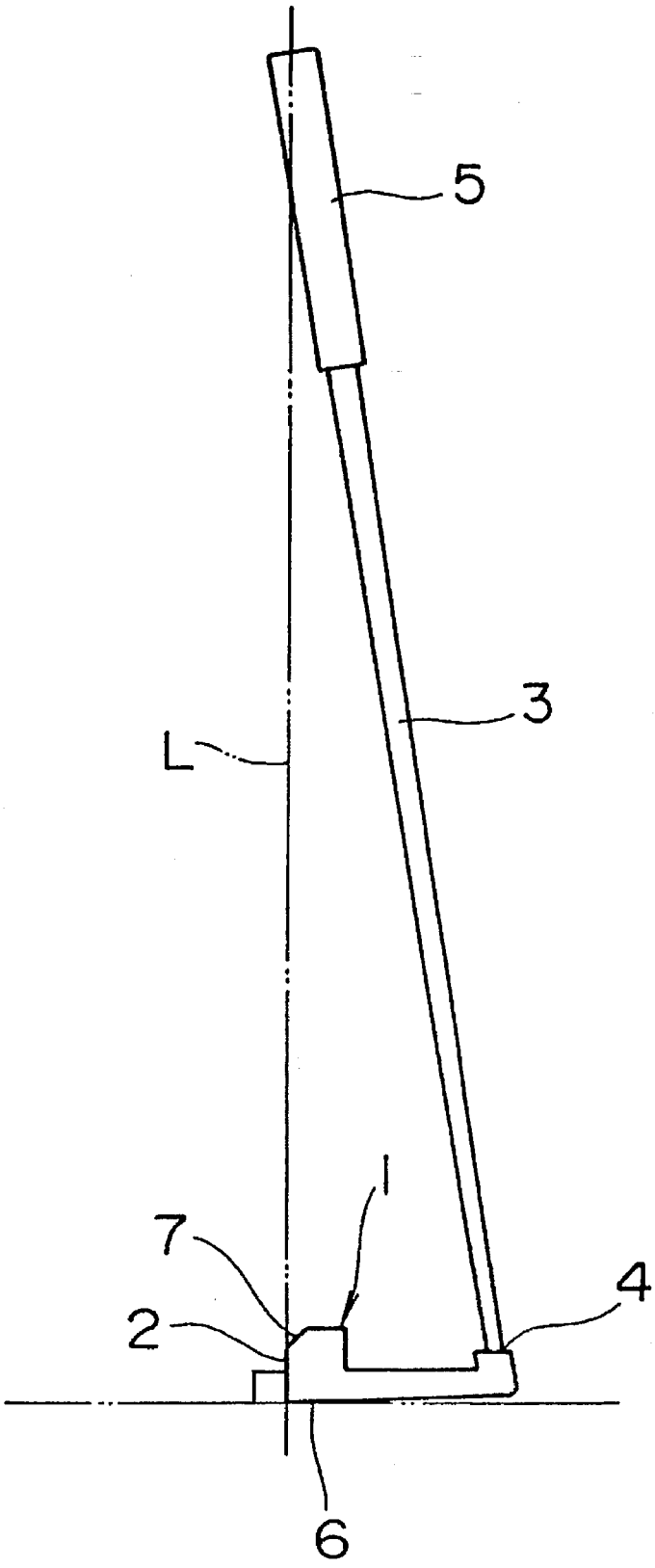
FIG. 2 is a front view of the embodiment shown in FIG. 1.
Figure 3:
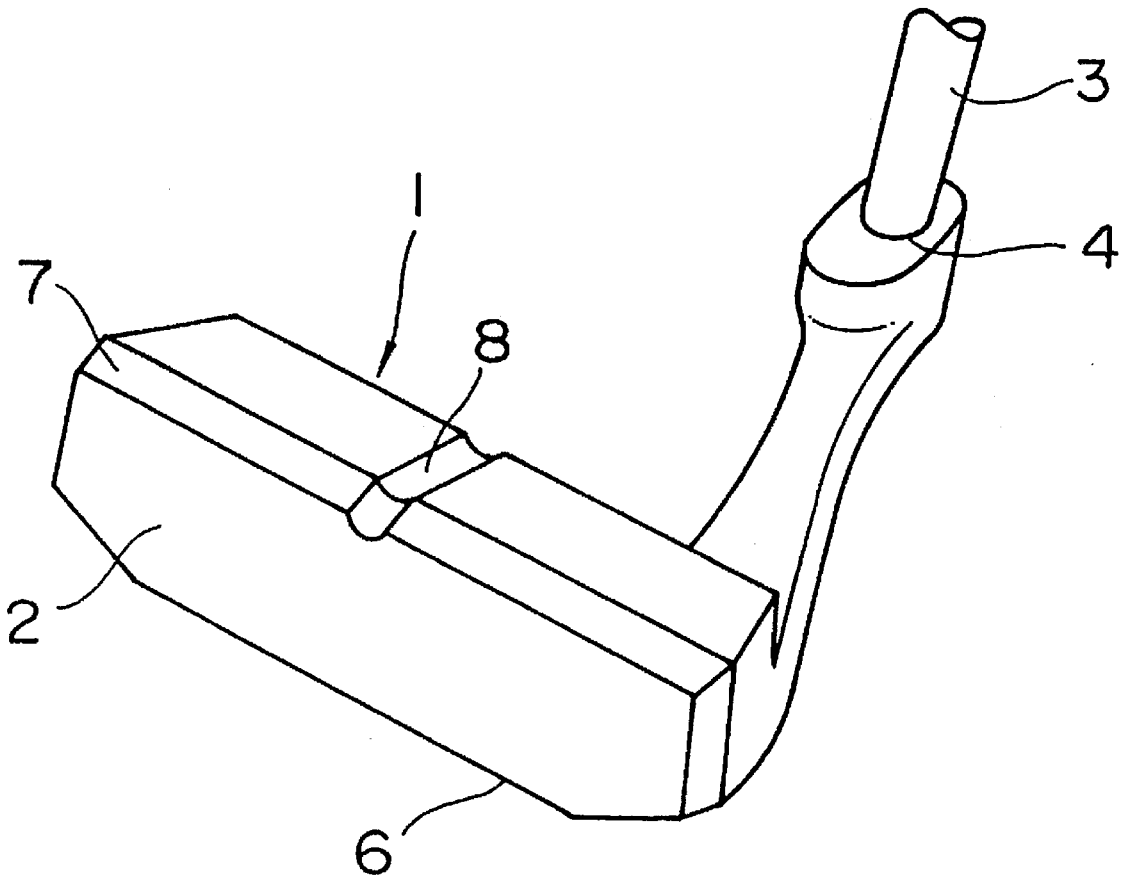
FIG. 3 is an enlarged perspective view showing a head portion in accordance with the embodiment shown in FIG. 1.

The shaft 3 is attached to the shaft attaching portion 4 so as to be inclined toward the face side of the putter head 1 as shown in FIGS. 1 and 2. Simultaneously, the shaft 3 is inclined, toward the front side in the front and rear direction.

This is not changed in comparison with the conventional club. The shaft 3 is inclined toward the side of the face 2 in such a manner that the grip 5 crosses the line L located in a plane which is orthogonal a line extending orthogonally from a lower edge portion of the face 2 of the head 1, or it comes to a position close to the line L. In this embodiment, the shaft 3 is attached to the shaft attaching portion 4 and is inclined so that the grip 5 crosses the line L.

The weight of the head 1 is increased at the side of the face 2. Also, when the club is held so that the head is suspended from leading portion of the grip 5, the face 2 of the head 1 is positioned substantially directly below the grip 5. Simultaneously, the face 2 of the head 1 is so set as to be in a nearly vertical state (as shown in FIG. 2), to thereby be directed downward, when the shaft 3 is point-supported i.e. held at the end of the shaft which is opposite the club head.

In the head 1, an upper portion of the face 2 has a chamfered tapered surface 7. A guide line 8 is formed in the tapered surface 7 and the upper surface of the head 1 so that it is positioned along a line that extends from the substantial center of the length of face 2 (the sweet spot) and is orthogonal to the surface of face 2. In this embodiment, the guide line 8 is formed by a groove, but, it is not limited thereto or thereby.

Figure 4:
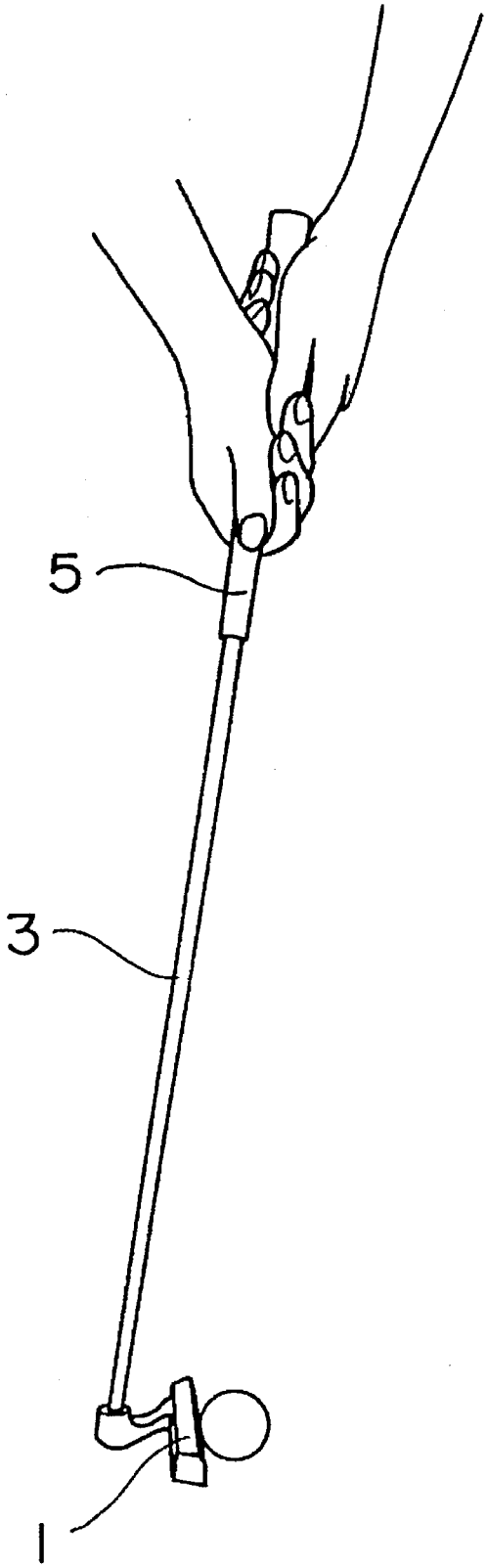
FIG. 4 is an explanatory diagram showing an operating state of the embodiment shown in FIG. 1.
Figure 5:
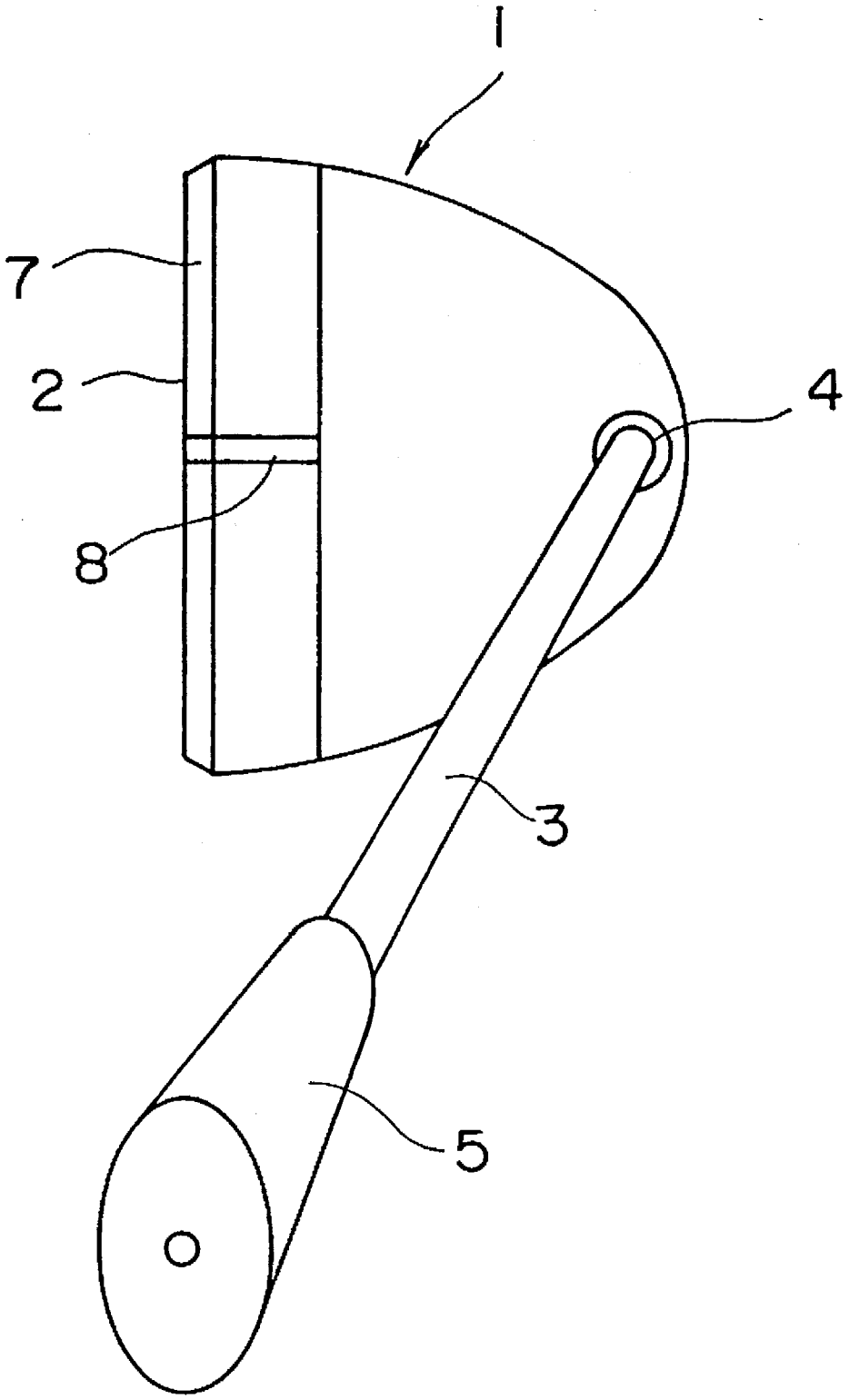
FIG. 5 is a plan view showing another embodiment of the present invention.
Figure 6:
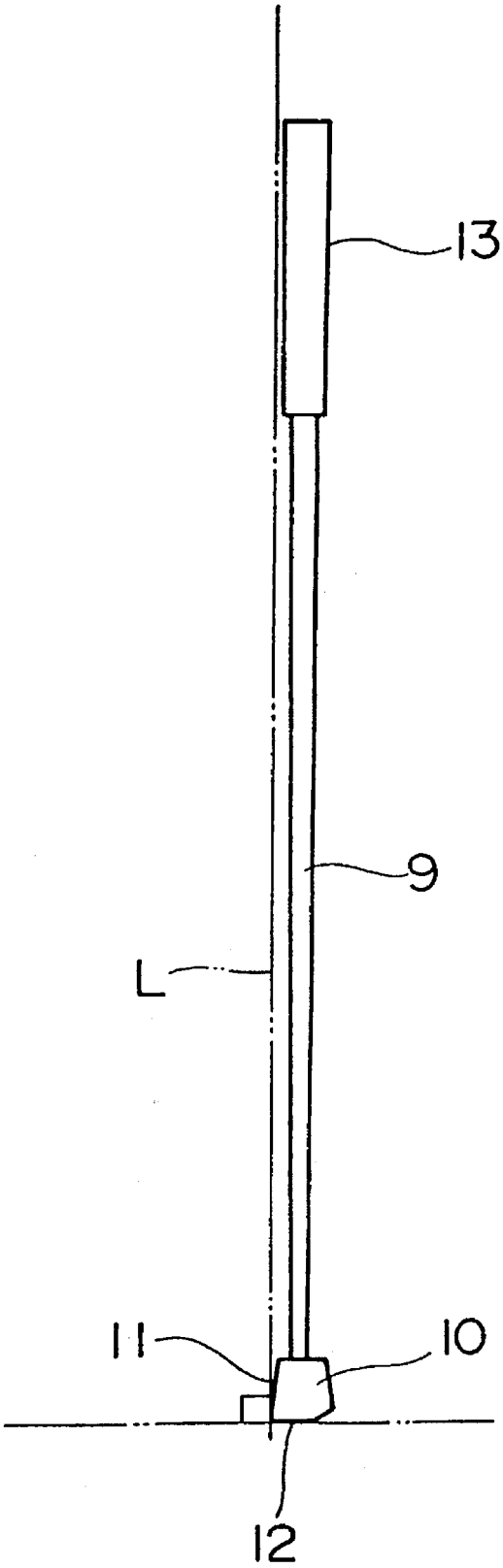
FIG.6 PRIOR ART
FIG. 6 is an explanatory diagram showing a conventional golf club.

According to the above-mentioned embodiment, the shaft attaching portion 4 is located at a predetermined distance D1 directly behind the substantial center of the face 2 of head 1, and the shaft 3 is attached to the shaft attaching portion 4 in such a manner that the shaft 3 is inclined toward the face side of the head 1. As a result, when the player addresses the ball while keeping the club at the center of his body, the target-side wrist is hardly bent outwardly, that is, the wrist remains substantially straight (FIG. 4).

In this state, when the player moves or swings the putter, because the player's wrists are not bent, a swing can be taken without twisting or turning the wrist. Also, movement of the elbows toward the target direction is facilitated. As a result, such a swing enables the putter head to move along the target line accurately from a take-back to a follow-through without opening or closing the face 2.

The shaft 3 is inclined toward the side of the putter face 2 in such a manner that the grip 5 crosses the line L which is located in a plane which is orthogonal to a line extending orthogonally from the lower edge portion of the face 2, or it comes to a position close to the line L. As a result, when the player grips the grip 5 while it is centered relative to the player's body, the position of the face 2 is also positioned at the substantial center of his body, which allows the player to hit a ball at the center of his body with a smooth swing.

The weight of the head 1 is increased at the side of the face 2. When the club head 1 is suspended by supporting the leading portion of the grip 5, the face 2 of the head 1 is positioned substantially directly below the grip 5. Simultaneously, the face 2 of the head 1 is so set as to be in a nearly vertical state,, when the shaft 3 is point-supported. As a result of the weight distribution, the head 1 is restrained from moving right and left during swinging as much as possible, to thereby facilitate a smooth swing without any forcible action.

In the head 1, the upper end portion of the face 2 has a chamfered or tapered surface 7, and the guide line 8 is formed on the tapered surface 7 and the upper surface of the head 1 so that it is positioned along a line that extends from the lateral center of the face 2 and is orthogonal to the surface of the face 2. Hence, when the face 2 is adjusted in relation to a ball, the player sees the guide line 8 formed on the tapered surface 7 as a vertical line with his eyes, and the sweet spot is-readily adjustable so as to be aligned with the core of the ball.

It should be noted that in the above-mentioned embodiment, the present invention is embodied by a putting club. However, the present invention is embodied by not only the putter but also a club, for example, used for an approach shot, which requires a swing without twisting or turning the wrists.

As was described above, according to the present invention, a swing without twisting or turning the player's wrist and a swing to allow the player's elbow to be moved toward the target direction are facilitated. As a result, such a swing as to take a stroke on a straight line with accuracy from a take-back to a follow-through is more readily performed without moving the face right and left i.e. without opening or closing the face. Hence, the golf club of the present invention is optimally suited to a putter or to a club used for an approach shot.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practicing the invention. The embodiment was chosen and described in order to explain the principles of the invention and its practical application so as to enable one skilled in the art to utilize the invention in various embodiments and with various modifications as are suited to the particular use contemplated. It is intended that the scope of the invention be defined by the claims appended hereto, and their equivalents.

I claim:

1. A-golf club comprising:

a club head having a face for striking a golf ball, said club head having a weight which is distributed such that the weight is greatest at a side of said club head including said face;

a shaft attaching portion connected to said club head and located a predetermined distance substantially directly behind a longitudinal center of said club head face; and a shaft having a first end and a second end, said second end being connected to said shaft attaching portion, said shaft being inclined from said shaft attaching portion in a direction toward said club head face.

2. The golf club as claimed in claim 1 wherein said shaft extends from said shaft attaching portion such that said first end of said shaft crosses a plane which passes through a bottom edge of said club head face and is orthogonal to a line extending orthogonally from a lower edge of said club head face.

3. The golf club as claimed in claim 1, wherein said shaft extends from said shaft attaching portion such that said first end is located near a plane which passes through a bottom edge of said club head face and is orthogonal to a line extending orthogonally from the lower edge of said club head face.

4. The golf club as claimed in claim 1, wherein said club head face has a length, and said shaft attaching portion is located behind said club head face a distance which is greater than one half the length of said face.

5. A golf club comprising:

a club head having a face for striking a golf ball;

a shaft attaching portion connected to said club head and located a predetermined distance substantially directly behind a longitudinal center of said club head face; and a shaft connected to said shaft attaching portion and extending therefrom at an angle in a direction toward said club head face, the weight of said club head being distributed in such a manner that the weight of said club head is greater at a side of said club head which includes said face so that when said club head is suspended by supporting only an end of said shaft, which is remote from said shaft attaching portion, said face is located directly below said supported end of said shaft.

6. The golf club as claimed in claim 5, further comprising a grip mounted on said shaft, wherein said club head face includes a bottom edge and said shaft extends from said shaft attaching portion such that said grip crosses a plane which includes a line defined by said bottom edge of said face and which is orthogonal to a line which extends orthogonally from said bottom edge of said face.

7. The golf club as claimed in claim 5, further comprising a grip mounted on said shaft, wherein said face includes a bottom edge and said shaft extends from said shaft attaching portion such that said grip extends to a position near a plane which includes a line defined by said bottom edge of said face and which is orthogonal to a line which extends orthogonally from said bottom edge of said face.

8. The golf club as claimed in claim 5, wherein said club head face has a length, and said shaft attaching portion is located behind said club head face a distance which is greater than one half the length of said face.

* * * * *